US012130042B2

(12) United States Patent
Obara

(10) Patent No.: US 12,130,042 B2
(45) Date of Patent: Oct. 29, 2024

(54) INDOOR UNIT OF AIR-CONDITIONING APPARATUS

(71) Applicant: Mitsubishi Electric Corporation, Tokyo (JP)

(72) Inventor: Koichi Obara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 579 days.

(21) Appl. No.: 17/437,995

(22) PCT Filed: May 30, 2019

(86) PCT No.: PCT/JP2019/021459
§ 371 (c)(1),
(2) Date: Sep. 10, 2021

(87) PCT Pub. No.: WO2020/240759
PCT Pub. Date: Dec. 3, 2020

(65) Prior Publication Data

US 2022/0178580 A1 Jun. 9, 2022

(51) Int. Cl.
*F24F 13/10* (2006.01)

(52) U.S. Cl.
CPC ..... *F24F 13/10* (2013.01)

(58) Field of Classification Search
CPC ..... F24F 13/10; F24F 13/08; F24F 13/105; F24F 13/1406; F24F 2013/1433
USPC ..... 454/358, 21, 268, 288
See application file for complete search history.

(56) References Cited

U.S. PATENT DOCUMENTS 10,288,303 B2 5/2019 Yaegashi et al.

FOREIGN PATENT DOCUMENTS

| | | | | |
|---|---|---|---|---|
| CN | 107327949 A | * | 11/2017 | ..... F24F 1/0011 |
| CN | 208025631 U | | 10/2018 | |
| JP | H07-190470 A | | 7/1995 | |
| JP | H11-237107 A | | 8/1999 | |
| JP | 2003-090592 A | | 3/2003 | |
| JP | 2009-144979 A | | 7/2009 | |

(Continued)

OTHER PUBLICATIONS

Adachi, Yusuke, WO2017134723 Translation.pdf, "Indoor unit for air-conditioner", Aug. 2017, pp. 1-10.*

(Continued)

*Primary Examiner* — Avinash A Savani
*Assistant Examiner* — Ryan L Faulkner
(74) *Attorney, Agent, or Firm* — Posz Law Group, PLC

(57) ABSTRACT

An indoor unit of an air-conditioning apparatus includes: a housing having an air inlet suctioning indoor air, an air outlet blowing out the air suctioned from the air inlet, an accommodation space connected to the air outlet and accommodating an electric component box, a wind up-down direction plate provided to the housing to cover the air outlet and the accommodation space, configured to adjust a direction of air blown out from the air outlet, and including a wind guide surface that guides the air blown out from the air outlet; and a wind shielding portion that obstructs the air blown out from the air outlet, the wind shielding portion being provided at an edge portion of a portion of the wind guide surface, the portion facing the accommodation space, the edge portion being disposed close to a rear side of the housing.

7 Claims, 9 Drawing Sheets

(56) References Cited

FOREIGN PATENT DOCUMENTS

| | | | | |
|---|---|---|---|---|
| JP | 2011-133158 | A | 7/2011 | |
| JP | 2012-037133 | A | 2/2012 | |
| JP | 2015-031454 | A | 2/2015 | |
| JP | 2019-020079 | A | 2/2019 | |
| WO | WO-2017134723 | A1 * | 8/2017 | ..... F24F 1/0011 |

OTHER PUBLICATIONS

Ye, Hailn, CN107327949 Translation.pdf, "Air conditioner", Nov. 2017, pp. 1-13.*
Office Action dated Aug. 31, 2022 issued in corresponding DE Patent Application No. 112019007369.9 (and English translation).
International Search Report of the International Searching Authority mailed Jul. 9, 2019 for the corresponding International Patent Application No. PCT/JP2019/021459 (and English translation).
Examination Report dated Aug. 17, 2022 issued in corresponding AU Patent Application No. 2019448451.
Office Action dated May 24, 2022 issued in corresponding JP Patent Application No. 2021-521677 (and English translation).

* cited by examiner

Comparative Example

INDOOR UNIT OF AIR-CONDITIONING APPARATUS

CROSS REFERENCE TO RELATED APPLICATION

This application is a U.S. national stage application of International Patent Application No. PCT/JP2019/021459 filed on May 30, 2019, the disclosure of which is incorporated herein by reference.

TECHNICAL FIELD

The present disclosure relates to an indoor unit of an air-conditioning apparatus including a wind up-down direction plate.

BACKGROUND ART

Hitherto, there is a known indoor unit of an air-conditioning apparatus, the indoor unit having an accommodation space that accommodates an electric component box. In such an indoor unit, an air outlet is provided at a position close to one side portion of the indoor unit, and the accommodation space is formed at a position close to the other side portion of the indoor unit. Further, there may be a case where the accommodation space is formed to be recessed from a housing, and is connected to the air outlet. That is, the accommodation space has an external appearance in which the accommodation space is integrally formed with the air outlet. In such a configuration, a wind up-down direction plate is disposed to extend over substantially the entire width of the lower portion of the housing, thus covering the air outlet and the accommodation space. Meanwhile, in the case where the accommodation space is not integrally formed with the air outlet, the accommodation space is not covered by the wind up-down direction plate. That is, the wind up-down direction plate covers only the air outlet and hence, the wind up-down direction plate is disposed close to one side portion of the housing in the width direction. Accordingly, by integrally forming the accommodation space with the air outlet, the indoor unit has higher design performance compared with the case where the accommodation space is not integrally formed with the air outlet. Meanwhile, at a portion of the wind up-down direction plate that faces the accommodation space, the momentum of air that is blown out is low and hence, warm air of the room may flow onto the portion of the wind up-down direction plate during a cooling operation performed by the air-conditioning apparatus. Accordingly, there is a possibility that condensation forms on the portion of the wind up-down direction plate that faces the accommodation space.

Patent Literature 1 discloses an indoor unit in which a wind up-down direction plate that guides air blown out from an air outlet has a wind guide surface, and a plurality of ribs are provided at a portion of the wind guide surface that faces an accommodation space. Each of the ribs has a substantially cuboid shape. However, the respective ribs have different heights, and are provided at substantially the center of the wind guide surface in the front-back direction such that the heights of the respective ribs increase in a stepwise manner toward the air outlet. Further, the longitudinal direction of each rib is parallel to the front-back direction of a housing. Accordingly, it is possible to prevent warm air of the room from flowing into a portion of the wind guide surface of the wind up-down direction plate, the portion having a dew point temperature or below. In this manner, the indoor unit of Patent Literature 1 suppresses formation of condensation on the wind up-down direction plate while maintaining design performance of the indoor unit.

CITATION LIST

Patent Literature

Patent Literature 1: Japanese Unexamined Patent Application Publication No. 2011-133158

SUMMARY OF INVENTION

Technical Problem

However, the ribs formed on the wind up-down direction plate of the indoor unit disclosed in Patent Literature 1 are provided substantially at the center of the wind guide surface in the front-back direction such that the longitudinal direction of the ribs is parallel to the front-back direction of the housing. Therefore, during the operation of the air-conditioning apparatus, air that is blown out flows along the wind guide surface such that the air passes through between the ribs. That is, air that is blown out does not flow over the design surface of the wind up-down direction plate and hence, warm air of the room stagnating on the design surface cannot be discharged. Accordingly, due to a temperature difference between cool air passing over the wind guide surface of the wind up-down direction plate and warm air of the room, condensation may occur on the design surface of the wind up-down direction plate.

The present disclosure has been made to solve the above-mentioned problem, and an object thereof is to provide an indoor unit of an air-conditioning apparatus in which condensation does not form on the design surface of the wind up-down direction plate while design performance of the indoor unit is maintained.

Solution to Problem

An indoor unit of an air-conditioning apparatus according to an embodiment of the present disclosure includes: a housing having an air inlet, an air outlet, and an accommodation space, the air inlet suctioning indoor air, the air outlet blowing out the air suctioned from the air inlet, the accommodation space being connected to the air outlet and accommodating an electric component box; and a wind up-down direction plate provided to the housing to cover the air outlet and the accommodation space, and configured to adjust a direction of air blown out from the air outlet, wherein the wind up-down direction plate has a wind guide surface that guides the air blown out from the air outlet, and the wind guide surface is provided with a wind shielding portion that obstructs the air blown out from the air outlet, the wind shielding portion being provided at an edge portion of a portion of the wind guide surface, the portion facing the accommodation space, the edge portion being disposed close to a rear side of the housing.

Advantageous Effects of Invention

According to an embodiment of the present disclosure, during a cooling operation performed by the air-conditioning apparatus, a portion of cool air blown out from the air outlet impinges on the wind shielding portion. When such impingement occurs, the cool air that impinges on the wind shielding portion flows toward the design surface of the wind up-down direction plate, and flows along the design surface of the wind up-down direction plate while pushing out warm air of the room stagnating on the design surface of the wind up-down direction plate. Meanwhile, cool air that does not impinge on the wind shielding portion is blown out from the indoor unit along the wind guide surface. That is, cool air flows over both the wind guide surface and the design surface of the wind up-down direction plate. Therefore, no temperature difference is generated between the wind guide surface and the design surface of the wind up-down direction plate. Accordingly, it is possible to prevent formation of condensation on the design surface of the wind up-down direction plate while high design performance of the indoor unit is maintained, the high design performance being obtained by integrally forming the accommodation space with the air outlet.

DESCRIPTION OF EMBODIMENT

Embodiment 1

Figure 1:
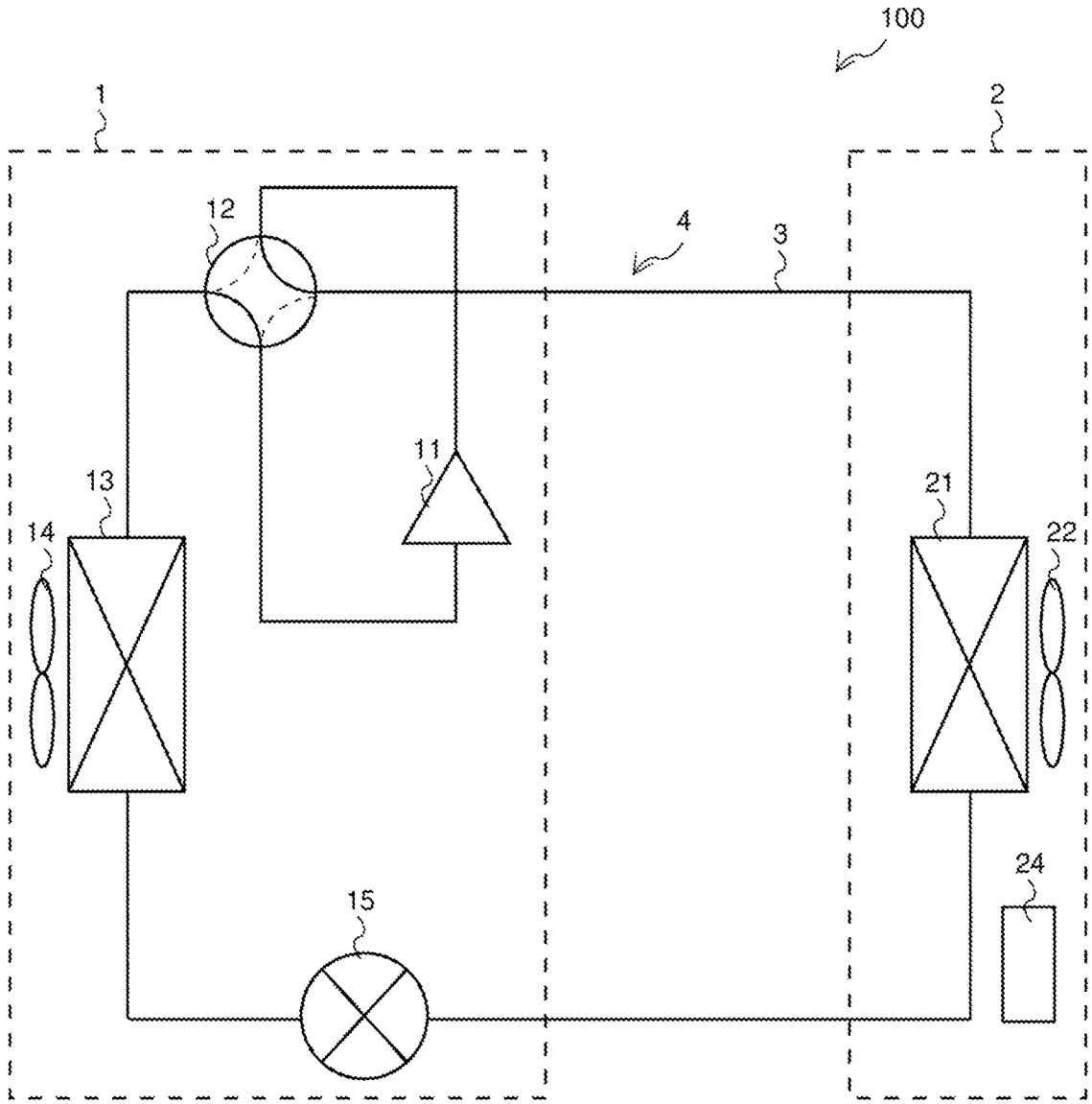
FIG. 1 is a circuit diagram illustrating an air-conditioning apparatus 100 according to Embodiment 1.

Hereinafter, an indoor unit 2 of an air-conditioning apparatus 100 according to Embodiment 1 will be described with reference to drawings. FIG. 1 is a circuit diagram illustrating the air-conditioning apparatus 100 according to Embodiment 1. As shown in FIG. 1, the air-conditioning apparatus 100 includes an outdoor unit 1, the indoor unit 2 and refrigerant pipes 3. In FIG. 1, the case where one indoor unit 2 is used is illustrated. However, two or more indoor units 2 may be used.

(Outdoor Unit 1, Indoor Unit 2, Refrigerant Pipes 3)

The outdoor unit 1 includes a compressor 11, a flow passage switching device 12, an outdoor heat exchanger 13, an outdoor air-sending device 14, and an expansion unit 15. The indoor unit 2 includes an indoor heat exchanger 21, an indoor air-sending device 22, a housing 23, an electric component box 24, wind up-down direction plates 25, and wind up-down direction plates 25. The refrigerant pipes 3 form a refrigerant circuit 4 by connecting the flow passage switching device 12, the outdoor heat exchanger 13, the expansion unit 15, and the indoor heat exchanger 21 with each other and by allowing refrigerant to flow therethrough.

(Compressor 11, Flow Passage Switching Device 12, Outdoor Heat Exchanger 13, Outdoor Air-Sending Device 14, Expansion Unit 15)

The compressor 11 suctions refrigerant at low temperature and low pressure, compresses the suctioned refrigerant to form refrigerant at high temperature and high pressure, and discharges the refrigerant. The flow passage switching device 12 switches a flow direction of refrigerant in the refrigerant circuit 4. The flow passage switching device 12 may be a four-way valve, for example. The outdoor heat exchanger 13 causes heat exchange to be performed between refrigerant and outdoor air. The outdoor heat exchanger 13 may be a fin-and-tube heat exchanger, for example. The outdoor heat exchanger 13 serves as a condenser during a cooling operation, and serves as an evaporator during a heating operation. The outdoor air-sending device 14 is equipment that sends outdoor air to the outdoor heat exchanger 13. The expansion unit 15 is a pressure reducing valve or an expansion valve that causes refrigerant to expand by reducing the pressure of the refrigerant.

(Indoor Heat Exchanger 21, Indoor Air-Sending Device 22)

The indoor heat exchanger 21 causes heat exchange to be performed between indoor air and refrigerant. The outdoor heat exchanger 13 serves as an evaporator during the cooling operation, and serves as a condenser during the heating operation. The indoor air-sending device 22 is equipment that sends indoor air to the indoor heat exchanger 21. The indoor air-sending device 22 may be a cross flow fan, for example.

(Cooling Operation)

The action of the air-conditioning apparatus 100 will be described. First, the cooling operation will be described. In the cooling operation, refrigerant suctioned into the compressor 11 is compressed by the compressor 11, and is discharged in a gas state at high temperature and high pressure. The refrigerant discharged from the compressor 11 in a gas state at high temperature and high pressure passes through the flow passage switching device 12, and flows into the outdoor heat exchanger 13 serving as the condenser. The refrigerant that flows into the outdoor heat exchanger 13 is caused to exchange heat with outdoor air sent by the outdoor air-sending device 14, thus being condensed and liquefied. The refrigerant in a liquid state flows into the expansion unit 15, and reduces in pressure and expands, thus becoming refrigerant in a two-phase gas-liquid state at low temperature and low pressure. The refrigerant in a two-phase gas-liquid state flows into the indoor heat exchanger 21 serving as the evaporator. The refrigerant that flows into the indoor heat exchanger 21 is caused to perform heat exchange with indoor air sent by the indoor air-sending device 22, thus being evaporated and gasified. At this point of operation, indoor air is cooled, so that the cooling operation is performed in the room. Thereafter, the evaporated refrigerant in a gas state at low temperature and low pressure passes through the flow passage switching device 12, and is suctioned into the compressor 11.

(Heating Operation)

Next, the heating operation will be described. In the heating operation, refrigerant suctioned into the compressor 11 is compressed by the compressor 11, and is discharged in a gas state at high temperature and high pressure. The refrigerant discharged from the compressor 11 in a gas state at high temperature and high pressure passes through the flow passage switching device 12, and flows into the indoor heat exchanger 21 serving as the condenser. The refrigerant that flows into the indoor heat exchanger 21 is caused to exchange heat with indoor air sent by the indoor air-sending device 22, thus being condensed and liquefied. At this point of operation, indoor air is heated, so that the heating operation is performed in the room. The refrigerant in a liquid state flows into the expansion unit 15, and reduces in pressure and expands, thus turning refrigerant into a two-phase gas-liquid state at low temperature and low pressure. The refrigerant in a two-phase gas-liquid state flows into the outdoor heat exchanger 13 serving as the evaporator. The refrigerant that flows into the outdoor heat exchanger 13 is caused to exchange heat with outdoor air sent by the outdoor air-sending device 14, thus being evaporated and gasified. Thereafter, the evaporated refrigerant in a gas state at low temperature and low pressure passes through the flow passage switching device 12, and is suctioned into the compressor 11.

(Housing 23)

Figure 2:
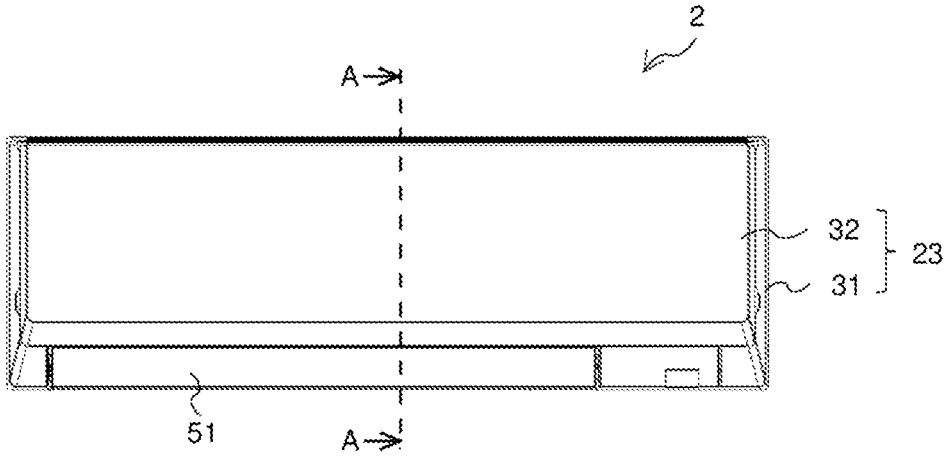
FIG. 2 is a front view illustrating an indoor unit 2 according to Embodiment 1.
Figure 3:
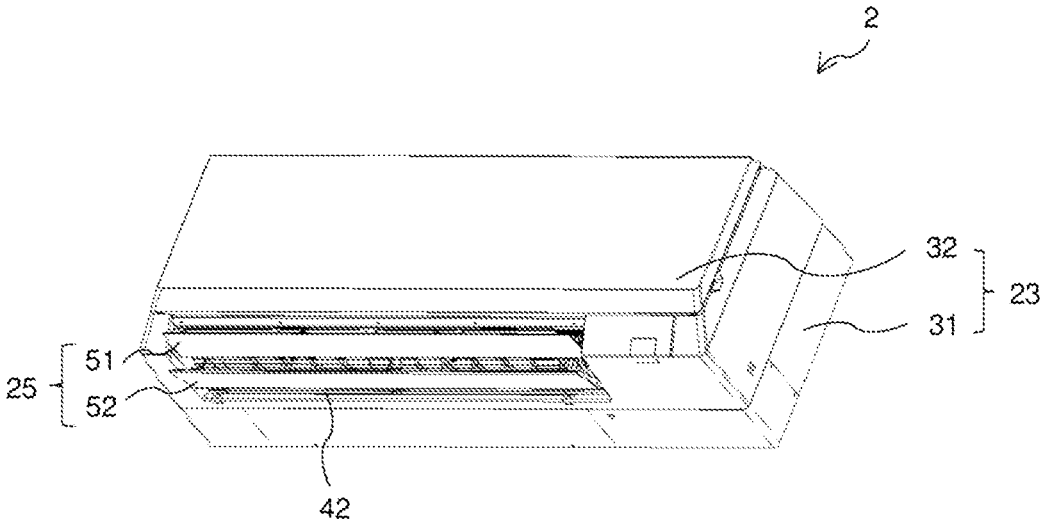
FIG. 3 is a perspective view illustrating the indoor unit 2 according to Embodiment 1.

FIG. 2 is a front view illustrating the indoor unit 2 according to Embodiment 1. FIG. 3 is a perspective view illustrating the indoor unit 2 according to Embodiment 1. As shown in FIG. 2 and FIG. 3, the housing 23 forms the outer shell of the indoor unit 2, and is made of a resin, for example. The housing 23 includes a casing 31 and a front panel 32.

(Casing 31)

Figure 4:
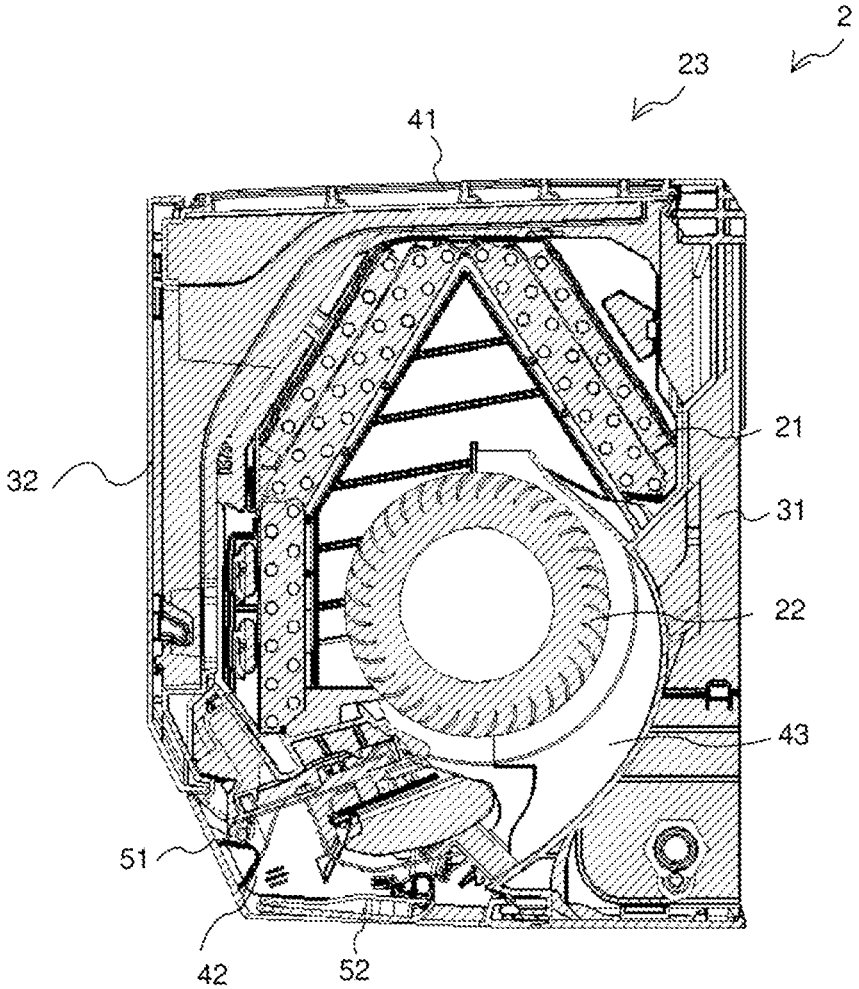
FIG. 4 is a cross-sectional view illustrating the indoor unit 2 according to Embodiment 1.
Figure 5:
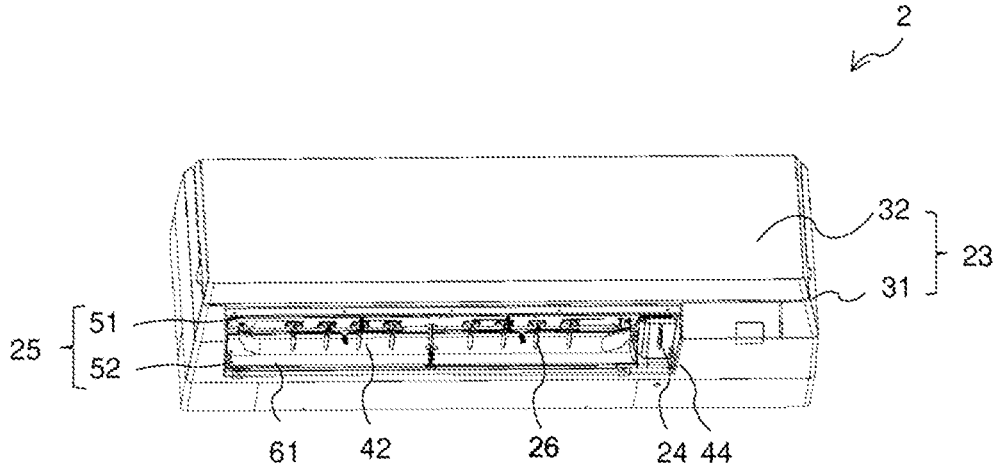
FIG. 5 is a perspective view illustrating the indoor unit 2 according to Embodiment 1.
Figure 6:
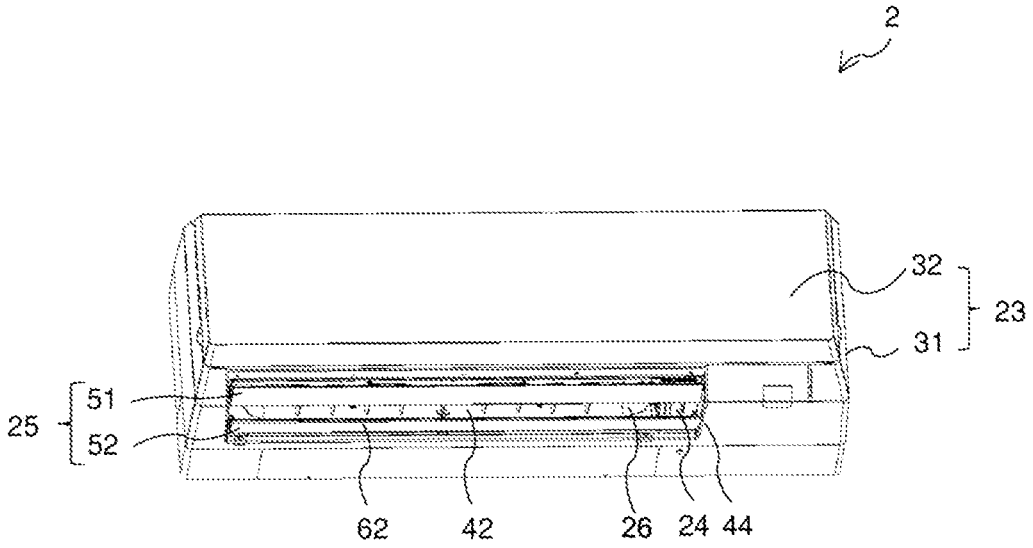
FIG. 6 is a perspective view illustrating the indoor unit 2 according to Embodiment 1.

FIG. 4 is a cross-sectional view illustrating the indoor unit 2 according to Embodiment 1 and illustrating a cross section taken along A-A in FIG. 2. FIG. 5 is a perspective view illustrating the indoor unit 2 according to Embodiment 1. FIG. 6 is a perspective view illustrating the indoor unit 2 according to Embodiment 1. As shown in FIG. 4 to FIG. 6, the casing 31 is a box body that allows respective pieces of equipment of the indoor unit 2 to be accommodated therein. The casing 31 is attached to a wall in the room. The casing 31 has an air inlet 41, an air outlet 42, an air passage 43, and an accommodation space 44. The casing 31 may be concealed in a ceiling, thus being used for a ceiling concealed indoor unit 2.

(Air Inlet 41, Air Outlet 42)

The air inlet 41 is an opening port formed in the upper portion of the casing 31. The air inlet 41 suctions indoor air into the inside of the indoor unit 2. The air inlet 41 may have any shape provided that the air inlet 41 can suction indoor air into the inside of the indoor unit 2. The air inlet 41 may also be formed in the front panel 32 in addition to the upper portion of the casing 31, or may be formed only in the front panel 32. The air outlet 42 is an opening port formed in the lower portion of the casing 31. The air outlet 42 blows out air into a room from the inside of the indoor unit 2. The air outlet 42 has a substantially rectangular shape, having long sides thereof extending in the width direction of the indoor unit 2. It is sufficient for the air outlet 42 to be able to blow out air from the inside of the indoor unit 2 and hence, the air outlet 42 may have a shape other than the substantially rectangular shape.

(Air Passage 43, Accommodation Space 44)

The air passage 43 is a space that connects the air inlet 41 with the air outlet 42. During the operation of the indoor unit 2, air suctioned from the air inlet 41 passes through the air passage 43. The air passage 43 is provided with the indoor heat exchanger 21 and the indoor air-sending device 22. The indoor heat exchanger 21 is disposed in an inverted V shape to surround the front surface and the upper surface of the indoor air-sending device 22. The indoor air-sending device 22 may not be disposed in an inverted V shape. The accommodation space 44 is a recess formed on the lower portion of the casing 31, and the electric component box 24 is accommodated in the accommodation space 44. The accommodation space 44 is connected to the air outlet 42, thus having an external appearance in which the accommodation space 44 is integrally formed with the air outlet 42.

(Front Panel 32, Electric Component Box 24)

The front panel 32 is connected to the casing 31, and forms the front surface of the outer shell of the indoor unit 2. The electric component box 24 is accommodated in the housing 23, and accommodates a motor (not shown in the drawing), an electronic control device (not shown in the drawing) and the like.

(Wind Up-Down Direction Plate 25)

The wind up-down direction plates 25 are plate-like parts, and are provided at the lower portion of the casing 31. The wind up-down direction plates 25 are two wind direction plates, that is, an upper wind direction plate 51 and a lower wind direction plate 52. During a period in which the operation of the air-conditioning apparatus 100 is stopped, the upper wind direction plate 51 covers the upper portion of the air outlet 42 and the upper portion of the accommodation space 44, and the lower wind direction plate 52 covers the lower portion of the air outlet 42 and the lower portion of the accommodation space 44. The number of wind up-down direction plates 25 may be one or three or more. The entire air outlet 42 and the entire accommodation space 44 are covered by all of the wind up-down direction plates 25. During the operation, the wind up-down direction plates 25 can be swung in the up-and-down direction by a motor (not shown in the drawing) to adjust the direction of air, blown out from the air outlet 42, in the up-and-down direction by maintaining or changing an opening degree. The wind up-down direction plates 25 are disposed over substantially the entire width of the lower portion of the housing 23, thus covering the air outlet 42 and the accommodation space 44.

Unlike Embodiment 1, in the case where the accommodation space 44 is not integrally formed with the air outlet 42, the wind up-down direction plates 25 do not cover the accommodation space 44. That is, the wind up-down direction plates 25 are disposed close to one side portion of the housing 23 in the width direction, thus covering only the air outlet 42. In contrast, in the indoor unit 2 of Embodiment 1, the accommodation space 44 is integrally formed with the air outlet 42, thus having higher design performance compared with the case where the accommodation space 44 is not integrally formed with the air outlet 42.

The lower wind direction plate 52 has two surfaces, that is, a wind guide surface 61 and a design surface 62. During the operation, the wind guide surface 61 forms the surface of the lower wind direction plate 52 on the air passage 43 side, and guides conditioned air blown out from the indoor unit 2. During a period in which the operation is stopped, the design surface 62 is a surface that forms an integral body with the housing 23 of the indoor unit 2, and that is disposed on the indoor side. The wind guide surface 61 is provided with a wind shielding portion 72. As described above, one or three or more wind up-down direction plates 25 may be provided. In the case where the number of wind up-down direction plates 25 is not two, the wind shielding portion 72 is provided to the wind up-down direction plate 25 disposed at the lowest position of the wind up-down direction plates 25.

(Wind Shielding Portion 72)

Figure 7:
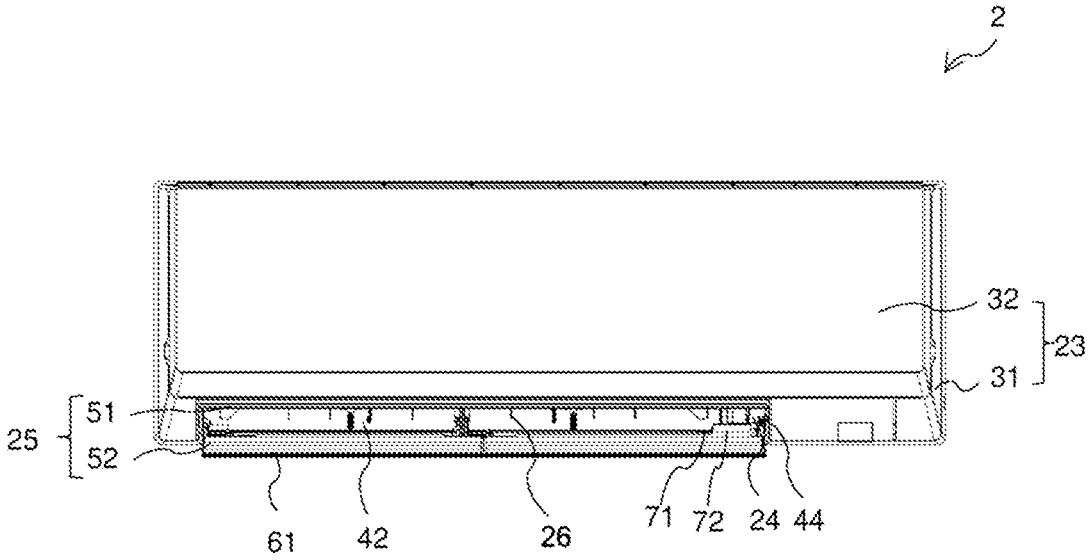
FIG. 7 is a front view illustrating the indoor unit 2 according to Embodiment 1.
Figure 8:
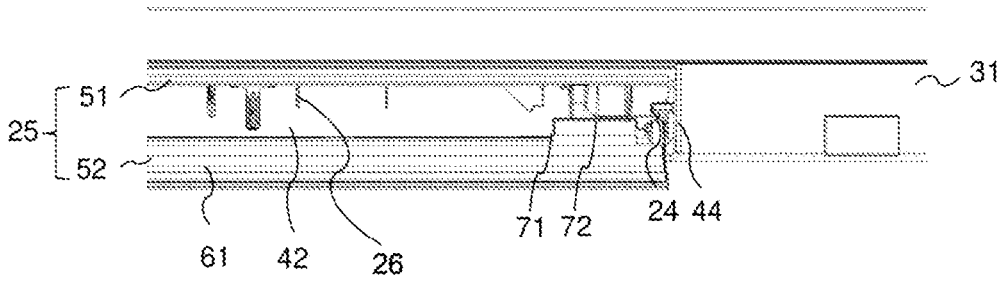
FIG. 8 is a front view illustrating a wind shielding portion 72 according to Embodiment 1.
Figure 9:
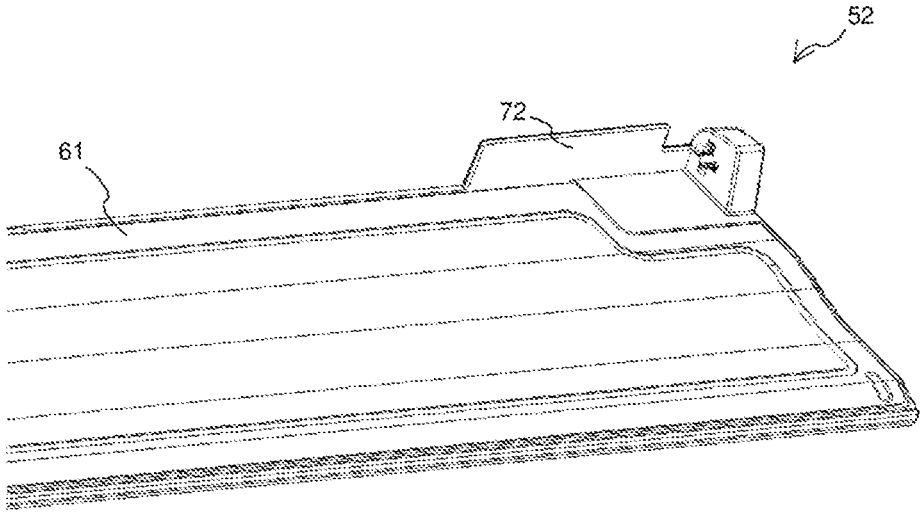
FIG. 9 is a perspective view illustrating the wind shielding portion 72 according to Embodiment 1.

FIG. 7 is a front view illustrating the indoor unit 2 according to Embodiment 1. FIG. 8 is a front view illustrating the wind shielding portion 72 according to Embodiment 1. FIG. 9 is a perspective view illustrating the wind shielding portion 72 according to Embodiment 1. As shown in FIG. 7, FIG. 8, and FIG. 9, the wind shielding portion 72 is a plate-like rib, and is provided at an edge portion 71 of a portion of the wind guide surface 61, the portion facing the accommodation space 44, the edge portion 71 being disposed close to the rear side of the housing 23. The wind shielding portion 72 is provided in an extending manner in the width direction to extend toward the air outlet 42 along the edge portion 71, and extends upward. The wind shielding portion 72 obstructs air blown out from the air outlet 42.

Figure 10:
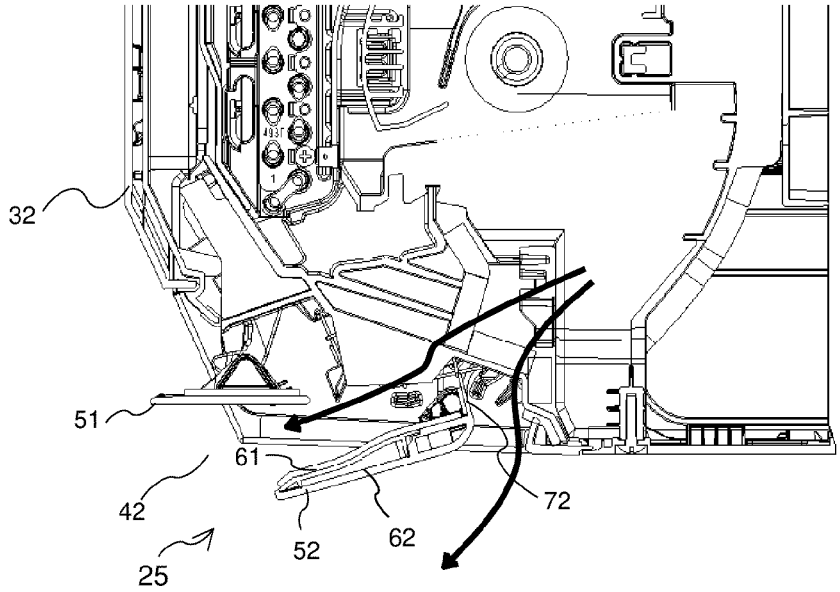
FIG. 10 is a cross-sectional view illustrating an air outlet 42 according to Embodiment 1.

FIG. 10 is a cross-sectional view illustrating the air outlet 42 according to Embodiment 1. The action of the indoor unit 2 and the manner of operation of the wind shielding portion 72 during the cooling operation performed by the air-conditioning apparatus 100 will be described with reference to FIG. 10. Indoor air is suctioned into the indoor unit 2 from the air inlet 41 of the indoor unit 2. Next, the air suctioned into the indoor unit 2 passes through the indoor heat exchanger 21 serving as the evaporator, so that the air is caused to exchange heat with air sent by the indoor air-sending device 22, thus turning into cool air. The cool air that is subjected to heat exchange is blown out from the air outlet 42, so that the cooling operation is performed in the room. The lower wind direction plate 52 of the wind up-down direction plate 25 is provided with the wind shielding portion 72 and hence, during the cooling operation, a portion of the cool air blown out from the air outlet 42 impinges on the wind shielding portion 72. The cool air that impinges on the wind shielding portion 72 flows toward the design surface 62 of the wind up-down direction plate 25, and flows along the design surface 62 of the wind up-down direction plate 25 while pushing out warm air of the room stagnating on the design surface 62 of the wind up-down direction plate 25. Meanwhile, cool air that does not impinge on the wind shielding portion 72 is blown out from the indoor unit 2 along the wind guide surface 61. That is, cool air flows over both the wind guide surface 61 and the design surface 62 of the wind up-down direction plate 25 and hence, no temperature difference is generated between the wind guide surface 61 and the design surface 62 of the wind up-down direction plate 25.

(Wind Left-Right Direction Plate 26)

Wind left-right direction plates 26 are plate-like parts, and a plurality of wind left-right direction plates 26 are provided in the air passage 43 at positions upstream of the wind up-down direction plates 25, which are provided at the lower portion of the casing 31. Each wind left-right direction plate 26 can be swung in the width direction by a motor (not shown in the drawing) to adjust the direction of air, blown out from the outdoor unit 1, in the left and right direction by maintaining or changing an angle.

According to Embodiment 1, during the cooling operation performed by the air-conditioning apparatus 100, a portion of cool air blown out from the air outlet 42 impinges on the wind shielding portion 72. When such impingement occurs, the cool air that impinges on the wind shielding portion 72 flows toward the design surface 62 of the wind up-down direction plate 25, and flows along the design surface 62 of the wind up-down direction plate 25 while pushing out warm air of the room stagnating on the design surface 62 of the wind up-down direction plate 25. Meanwhile, cool air that does not impinge on the wind shielding portion 72 is blown out from the indoor unit 2 along the wind guide surface 61. That is, cool air flows over both the wind guide surface 61 and the design surface 62 of the wind up-down direction plate 25. Therefore, no temperature difference is generated between the wind guide surface 61 and the design surface 62 of the wind up-down direction plate 25. Accordingly, it is possible to prevent formation of condensation on the design surface 62 of the wind up-down direction plate 25 while high design performance of the indoor unit 2 is maintained, the high design performance being obtained by integrally forming the accommodation space 44 with the air outlet 42.

Figure 11:
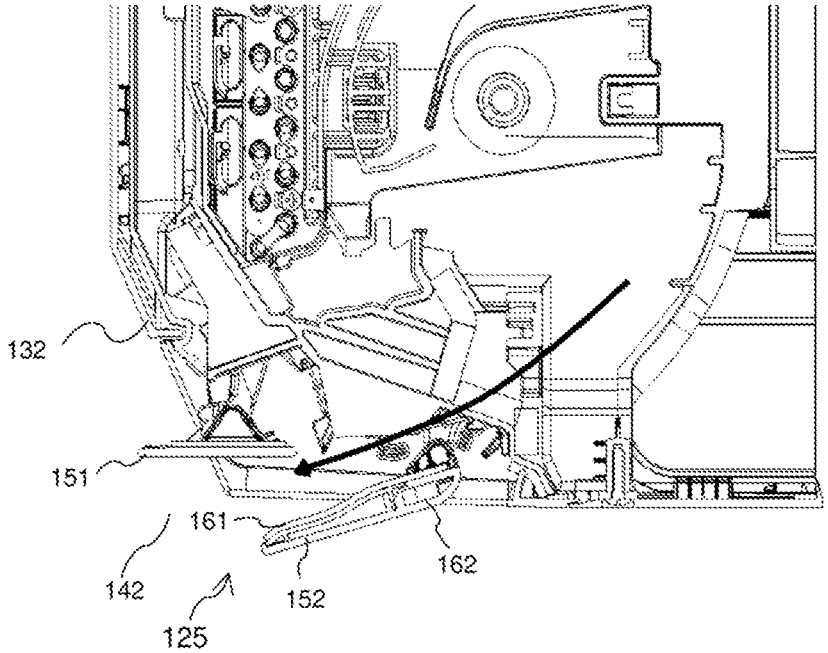
FIG. 11 is a cross-sectional view illustrating an air outlet 42 according to a comparative example.

FIG. 11 is a cross-sectional view illustrating an air outlet 142 according to a comparative example. The advantageous effects of Embodiment 1 will be described in detail by comparing Embodiment 1 with the comparative example shown in FIG. 11. As shown in FIG. 11, wind up-down direction plates 125 are two wind direction plates, that is, an upper wind direction plate 151 and a lower wind direction plate 152, and is located at a position below a front panel 132. The lower wind direction plate 152 of the comparative example includes no wind shielding portion and hence, almost all of cool air blown out from the air outlet 142 flows along a wind guide surface 161. Accordingly, warm air of the room stagnating on a design surface 162 cannot be discharged. Therefore, due to a temperature difference between warm air stagnating on the design surface 162 and cool air flowing over the wind guide surface 161, there is a possibility that condensation forms on the wind up-down direction plate 125.

In contrast, the wind up-down direction plate 25 of Embodiment 1 is provided with the wind shielding portion 72. With such a configuration, during the cooling operation performed by the air-conditioning apparatus 100, a portion of cool air blown out from the air outlet 42 impinges on the wind shielding portion 72. When such impingement occurs, the cool air that impinges on the wind shielding portion 72 flows toward the design surface 62 of the wind up-down direction plate 25, and flows along the design surface 62 of the wind up-down direction plate 25 while pushing out warm air of the room stagnating on the design surface 62 of the wind up-down direction plate 25. Meanwhile, cool air that does not impinge on the wind shielding portion 72 is blown out from the indoor unit 2 along the wind guide surface 61. That is, cool air flows over both the wind guide surface 61 and the design surface 62 of the wind up-down direction plate 25. Therefore, no temperature difference is generated between the wind guide surface 61 and the design surface 62 of the wind up-down direction plate 25. Accordingly, it is possible to suppress formation of condensation on the wind up-down direction plate 25 while high design performance of the indoor unit 2 is maintained, the high design performance being obtained by integrally forming the accommodation space 44 with the air outlet 42.

It is sufficient that the wind shielding portion 72 is provided at the edge portion 71 of the portion of the wind guide surface 61, the portion facing the accommodation space 44, the edge portion 71 being disposed close to the rear side of the housing 23. In the case where the wind shielding portion 72 is provided at the center of the wind up-down direction plate 25 in the front-back direction, cool air that impinges on the wind shielding portion 72 may generate turbulence in a space behind the wind guide surface 61. Therefore, cool air blown out from the air outlet 42 does not smoothly flow toward the design surface 62. In contrast, the wind shielding portion 72 of Embodiment 1 is provided at the edge portion 71 disposed close to the rear side of the housing 23 and hence, cool air that impinges on the wind shielding portion 72 is smoothly introduced toward the design surface 62. Meanwhile, cool air that does not impinge on the wind shielding portion 72 is blown out from the indoor unit 2 along the wind guide surface 61. That is, cool air flows over both the wind guide surface 61 and the design surface 62 of the wind up-down direction plate 25. Therefore, no temperature difference is generated between the wind guide surface 61 and the design surface 62 of the wind up-down direction plate 25. Accordingly, it is possible to suppress formation of condensation on the wind up-down direction plate 25 while high design performance of the indoor unit 2 is maintained, the high design performance being obtained by integrally forming the accommodation space 44 with the air outlet 42.

Further, according to Embodiment 1, the wind shielding portion 72 is provided at the edge portion 71 of the portion of the wind guide surface 61, the portion facing the accommodation space 44, the edge portion 71 being disposed close to the rear side of the housing 23, and the wind shielding portion 72 expands in the width direction along the edge portion 71 and extends upward. With such a configuration, during the cooling operation performed by the air-conditioning apparatus 100, a portion of cool air blown out from the air outlet 42 impinges on the wind shielding portion 72 with certainty. When such impingement occurs, the cool air that impinges on the wind shielding portion 72 flows toward the design surface 62 of the wind up-down direction plate 25, and is blown out along the design surface 62 of the wind up-down direction plate 25 while pushing out warm air of the room stagnating on the design surface 62 of the wind up-down direction plate 25. Meanwhile, cool air that does not impinge on the wind shielding portion 72 is blown out from the indoor unit 2 along the wind guide surface 61. That is, cool air flows over both the wind guide surface 61 and the design surface 62 of the wind up-down direction plate 25. Therefore, no temperature difference is generated between the wind guide surface 61 and the design surface 62 of the wind up-down direction plate 25. Accordingly, it is possible to further suppress formation of condensation on the wind up-down direction plate 25 while high design performance of the indoor unit 2 is maintained, the high design performance being obtained by integrally forming the accommodation space 44 with the air outlet 42.

Further, according to Embodiment 1, the wind shielding portion 72 is provided to extend toward the air outlet 42. With such a configuration, of the cool air blown out from the air outlet 42, the amount of cool air that impinges on the wind shielding portion 72 increases. Therefore, it is possible to more efficiently push out air stagnating on the design surface 62. Accordingly, it is possible to further suppress formation of condensation on the wind up-down direction plate 25.

Figure 12:
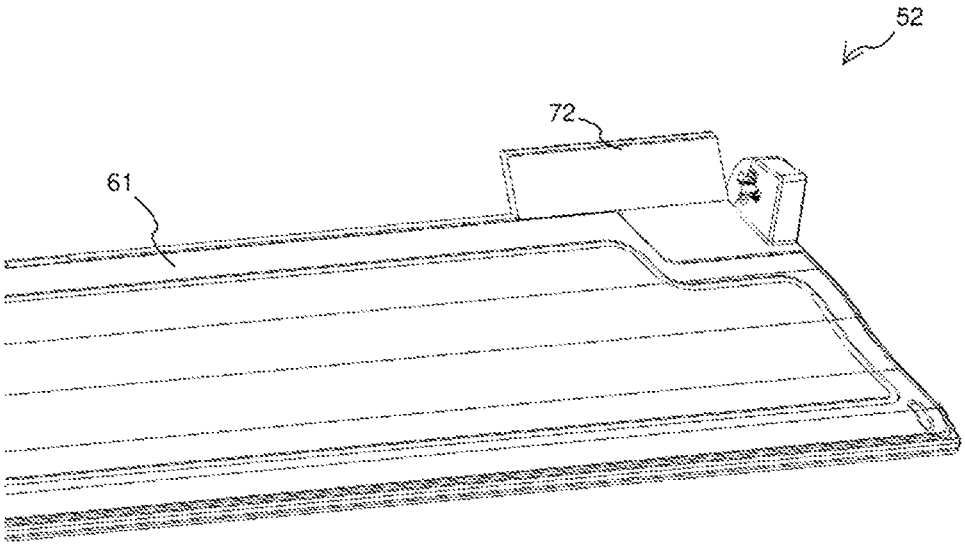
FIG. 12 is a perspective view illustrating the wind shielding portion 72 according to Embodiment 1.
Figure 13:
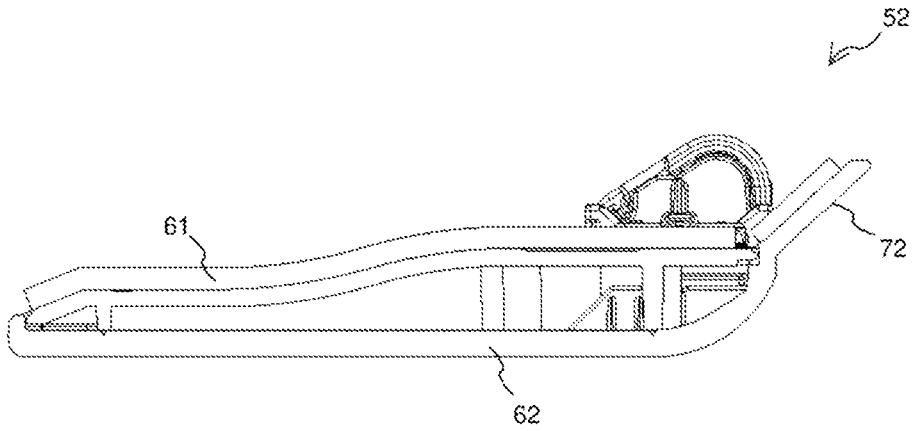
FIG. 13 is a cross-sectional view illustrating the wind shielding portion 72 according to Embodiment 1.

FIG. 12 is a perspective view illustrating the wind shielding portion 72 according to Embodiment 1. FIG. 13 is a cross-sectional view illustrating the wind shielding portion 72 according to Embodiment 1. As shown in FIG. 12 and FIG. 13, the back surface of the wind shielding portion 72 may also be formed to extend toward the rear side and the upper side of the housing 23. In general, in the case where the back surface of the wind shielding portion 72 is formed to extend only upward, the wind shielding portion 72 has a shape substantially orthogonal to a direction in which cool air blown out from the air outlet 42 flows. Therefore, when cool air blown out from the air outlet 42 impinges on the wind shielding portion 72, wind pressure may be lowered, or turbulence may be generated in the vicinity of the wind shielding portion 72. As a result, there is a possibility that the amount of cool air flowing along the wind guide surface 61 is reduced, thus lowering efficiency of air conditioning.

In contrast, in the case where the back surface of the wind shielding portion 72 is formed to extend toward the rear side and the upper side of the housing 23, the back surface of the wind shielding portion 72 has a shape substantially parallel to a direction in which cool air blown out from the air outlet 42 flows. Therefore, when a portion of the cool air blown out from the air outlet 42 impinges on the wind shielding portion 72, it is possible to suppress lowering of wind pressure and generation of turbulence in the vicinity of the wind shielding portion 72. Accordingly, there is no possibility that the amount of cool air flowing along the wind guide surface 61 is excessively reduced and hence, it is possible to suppress formation of condensation on the wind up-down direction plate 25 without lowering efficiency of air conditioning.

Figure 14:
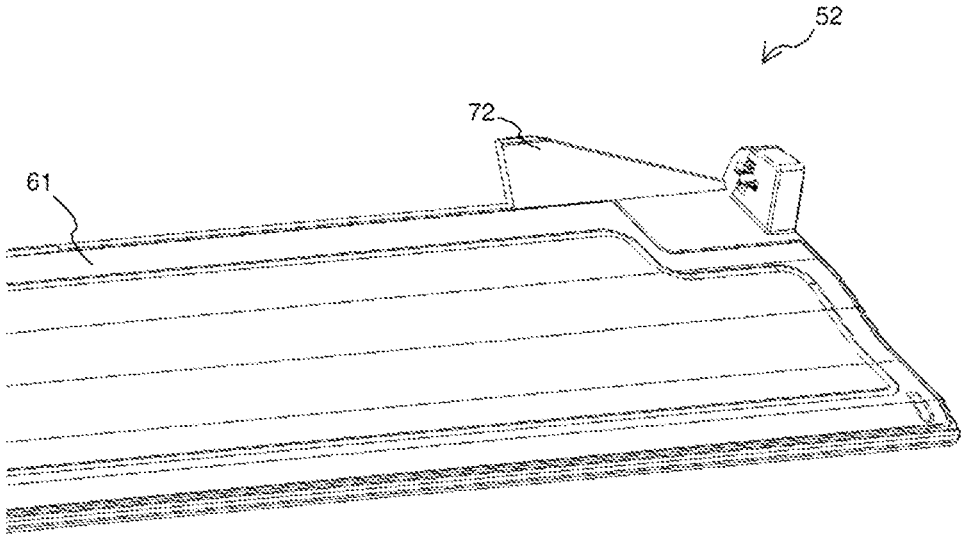
FIG. 14 is a perspective view illustrating the wind shielding portion 72 according to Embodiment 1.

FIG. 14 is a perspective view illustrating the wind shielding portion 72 according to Embodiment 1. As shown in FIG. 14, the wind shielding portion 72 may be formed such that the height of the wind shielding portion 72 increases toward the air outlet 42. In general, the amount of cool air that impinges on the wind shielding portion 72 can be increased by increasing the area of the back surface of the wind shielding portion 72. A greater effect of increasing the amount of cool air that impinges on the wind shielding portion 72 is obtained by disposing the large-height portion of the wind shielding portion 72 closer to the air outlet 42. In contrast, a smaller effect of increasing the amount of cool air that impinges on the wind shielding portion 72 is obtained by disposing the large-height portion of the wind shielding portion 72 farther from the air outlet 42. Therefore, by forming the wind shielding portion 72 such that the height of the wind shielding portion 72 increases toward the air outlet 42, it is possible to suppress formation of condensation on the wind up-down direction plate 25 while the amount of material used for forming the wind up-down direction plate 25 is suppressed.

Figure 15:
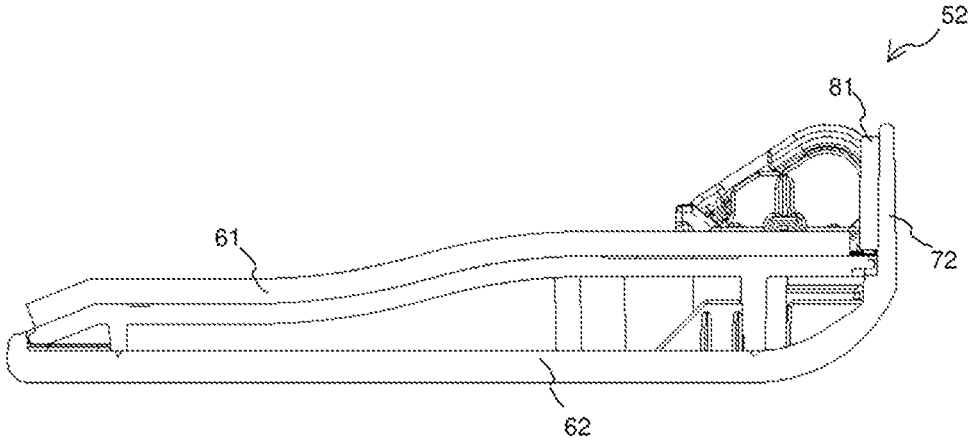
FIG. 15 is a cross-sectional view illustrating the wind shielding portion 72 according to Embodiment 1.

FIG. 15 is a cross-sectional view illustrating the wind shielding portion 72 according to Embodiment 1. As shown in FIG. 15, a heat insulating material 81 that suppresses heat transfer may be caused to adhere to the front surface of the wind shielding portion 72. The heat insulating material 81 may be a heat-insulating insulator (INS), for example. In general, during the cooling operation performed by the air-conditioning apparatus 100, warm air of the room may flow onto the front surface of the wind shielding portion 72. In such a case, due to a temperature difference between cool air blown to the back surface of the wind shielding portion 72 from the air outlet 42 and warm air that flows onto the front surface of the wind shielding portion 72, there is a possibility that condensation forms on the wind shielding portion 72. In the case where the heat insulating material 81 is caused to adhere to the front surface of the wind shielding portion 72, it is possible to prevent warm air from being cooled and hence, it is possible to suppress formation of condensation on the wind shielding portion 72. The heat insulating material 81 is caused to adhere to the front surface of the wind shielding portion 72 and hence, during a period in which the operation of the air-conditioning apparatus 100 is stopped, the heat insulating material 81 is concealed on the inside of the housing 23. That is, even when the heat insulating material 81 is caused to adhere to the front surface of the wind shielding portion 72, design performance is not reduced.

Figure 16:
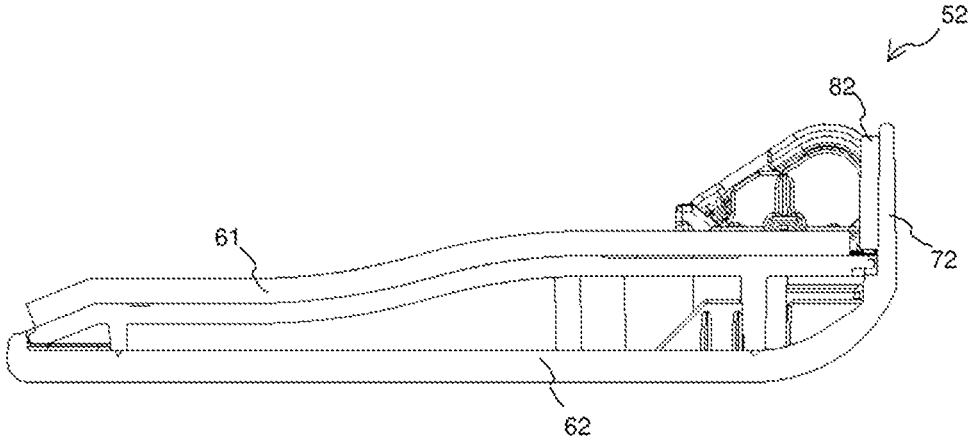
FIG. 16 is a cross-sectional view illustrating the wind shielding portion 72 according to Embodiment 1.

FIG. 16 is a cross-sectional view illustrating the wind shielding portion 72 according to Embodiment 1. As shown in FIG. 16, a water absorbing material 82 that absorbs moisture may be caused to adhere to the front surface of the wind shielding portion 72. The water absorbing material 82 may be a water-absorbing insulator (INS), for example. As described above, due to a temperature difference between cool air blown to the back surface of the wind shielding portion 72 from the air outlet 42 and warm air that flows onto the front surface of the wind shielding portion 72, there is a possibility that condensation forms on the wind shielding portion 72. In the case where the water absorbing material 82 is caused to adhere to the front surface of the wind shielding portion 72, the water absorbing material 82 absorbs moisture contained in warm air in the vicinity of the wind shielding portion 72 and hence, it is possible to suppress formation of condensation on the wind shielding portion 72. In the same manner as the heat insulating material, the water absorbing material 82 is caused to adhere to the front surface of the wind shielding portion 72 and hence, during a period in which the operation of the air-conditioning apparatus 100 is stopped, the water absorbing material 82 is concealed on the inside of the housing 23. That is, even when the water absorbing material 82 is caused to adhere to the front surface of the wind shielding portion 72, design performance is not reduced.

REFERENCE SIGNS LIST

1: outdoor unit, 2: indoor unit, 3: refrigerant pipe, 4: refrigerant circuit, 11: compressor, 12: flow passage switching device, 13: outdoor heat exchanger, 14: outdoor air-sending device, 15: expansion unit, 21: indoor heat exchanger, 22: indoor air-sending device, 23: housing, 24: electric component box, 25: wind up-down direction plate, 26: wind left-right direction plate, 31: casing, 32: front panel, 41: air inlet, 42: air outlet, 43: air passage, 44: accommodation space, 51: upper wind direction plate, 52: lower wind direction plate, 61: wind guide surface, 62: design surface, 71: edge portion, 72: wind shielding portion, 81: heat insulating material, 82: water absorbing material, 100: air-conditioning apparatus, 125: wind up-down direction plate, 142: air outlet, 161: wind guide surface, 162: design surface.

The invention claimed is:

1. An indoor unit of an air-conditioning apparatus, the indoor unit comprising:

a housing having an air inlet, an air outlet, and an accommodation space, the air inlet suctioning indoor air, the air outlet blowing out the air suctioned from the air inlet, the accommodation space being a recess formed in the housing which is connected to the air outlet and which accommodates an electric component box; and a wind up-down direction plate provided to the housing to cover the air outlet and the accommodation space, and configured to adjust a direction of air blown out from the air outlet, wherein the wind up-down direction plate has a wind guide surface that guides the air blown out from the air outlet, the wind guide surface is provided with a wind shielding portion that obstructs the air blown out from the air outlet, the wind shielding portion is provided at an edge portion of a portion of the wind guide surface, the edge portion of the portion of the wind guide surface is constructed adjacent to an axis of rotation of the wind up-down direction plate, and a height of the wind shielding portion covers the axis of rotation from an upstream wind, the portion of the wind guide surface faces the accommodation space, and the edge portion of the portion of the wind guide surface is disposed close to a rear side of the housing.

2. The indoor unit of an air-conditioning apparatus of claim 1, wherein the wind shielding portion is provided to extend upward and along a rear edge portion of the wind up-down direction plate.

3. The indoor unit of an air-conditioning apparatus of claim 1, wherein the wind shielding portion is provided to extend toward the air outlet.

4. The indoor unit of an air-conditioning apparatus of claim 1, wherein a back surface of the wind shielding portion is formed to extend toward the rear side and an upper side of the housing.

5. The indoor unit of an air-conditioning apparatus of claim 1, wherein the height of the wind shielding portion increases toward the air outlet.

6. The indoor unit of an air-conditioning apparatus of claim 1, wherein a heat insulating material is caused to adhere to the wind shielding portion, the heat insulating material suppressing heat transfer.

7. The indoor unit of an air-conditioning apparatus of claim 1, wherein a water absorbing material is caused to adhere to the wind shielding portion, the water absorbing material absorbing moisture.

* * * * *